US005131867A

United States Patent [19]

Peloza et al.

[11] Patent Number: 5,131,867

[45] Date of Patent: Jul. 21, 1992

[54] ANTI-VIBRATION ELECTRICAL CONNECTOR WITH STRESS RELIEF

[75] Inventors: Kirk B. Peloza, Wheaton; James T. Roberts, Oak Park; Gordon W. Funck, Naperville, all of Ill.

[73] Assignee: Molex Incorporated, Lisle, Ill.

[21] Appl. No.: 774,405

[22] Filed: Oct. 10, 1991

Related U.S. Application Data

[63] Continuation-in-part of Ser. No. 597,479, Oct. 15, 1990, abandoned.

[51] Int. Cl.[5] ..... H01R 13/73

[52] U.S. Cl. ..... 439/557; 439/552; 439/680

[58] Field of Search ..... 439/544, 549, 550, 552, 439/553, 555, 556, 557, 558, 567, 677, 680, 681, 382, 384

[56] References Cited

U.S. PATENT DOCUMENTS

| | | | |
|---|---|---|---|
| 3,067,974 | 12/1962 | Baldwin | 439/552 |
| 3,218,448 | 11/1965 | Cala | 439/553 |
| 3,523,269 | 8/1970 | Witek, Jr. et al. | 439/557 |
| 4,112,282 | 9/1978 | Piber | 439/555 |
| 4,603,929 | 8/1986 | Fitzpatrick | 439/552 |

FOREIGN PATENT DOCUMENTS

| | | | |
|---|---|---|---|
| 2316582 | 10/1973 | Fed. Rep. of Germany | 439/557 |

*Primary Examiner*—David L. Pirlot
*Attorney, Agent, or Firm*—Stephen Z. Weiss

[57] ABSTRACT

An electrical connector is disclosed for mounting in an aperture in a panel or the like and includes a housing. A yieldable anti-vibration arm projects from the housing for engaging the panel when the connector is mounted in the aperture in the panel to prevent vibration between the connector and the panel. A recess is formed in the anti-vibration arm at a location to relieve stress in the arm during yielding thereof.

21 Claims, 1 Drawing Sheet

ANTI-VIBRATION ELECTRICAL CONNECTOR WITH STRESS RELIEF

This is a continuation-in-part of copending application Ser. No. 07/597,479 filed Oct. 15, 1990, now abandoned.

FIELD OF THE INVENTION

This invention generally relates to the art of electrical connectors and, particularly, to an anti-vibration electrical connector which has means for relieving stress in an anti-vibration arm thereof.

BACKGROUND OF THE INVENTION

Electrical connectors are used in a variety of applications or environments wherein it is desirable or necessary to protect the connector components or the mating connection of the connector with a complementary connector from vibrations due to the mounting of the connector. The applications can range from automobiles to refrigerators and countless other environments.

Likewise, the provision of anti-vibration means can take a wide range of forms, from fastening means for rigidly fixing the connector to its support, to more versatile means such as snap-action mounting means.

For instance, a connector housing can be molded with an integral anti-vibration arm which is yieldable or sufficiently flexible to bias the connector against its mount and to take up any slack therebetween which might otherwise result in rattling of the connector in response to vibrations. The anti-vibration arm could engage and yield against one side of a panel, for instance, in a panel-mounted connector, or the anti-vibration arm might yieldably engage an abutment surface on a complementary connector.

One of the problems with using anti-vibration arms, flanges, or the like which are integral with a molded dielectric connector housing, is that the anti-vibration means are subject to stresses, particularly when cantilevered outwardly from a substantially rigidified housing wall. Dielectric housings of most connectors are fabricated of plastic material, and the cantilevered anti-vibration arms, flanges or the like too often are subject to breakage when encountering undue stress.

This invention is directed to solving these problems by providing a new and improved electrical connector which includes stress relief means in its anti-vibration means.

SUMMARY OF THE INVENTION

An object, therefore, of the invention is to provide an electrical connector with anti-vibration means in which is incorporated stress relief means.

In the exemplary embodiment of the invention, the electrical connector is adapted for mounting in an aperture in a panel or the like and includes an appropriate housing. A yieldable or flexible anti-vibration arm projects from the housing for engaging the panel when the connector is mounted in the aperture to prevent vibration between the connector and the panel. Recess means are provided in the anti-vibration arm at a location to relieve stress in the arm during yielding thereof caused by a polarizing rib.

As disclosed herein, the anti-vibration arm is cantilevered from a rigid wall of the housing, as where the wall is thickened by the polarizing rib. The recess means is formed in the anti-vibration arm either at or near the portion of the arm close to the polarizing rib and may be in the form of a hole or rectangular portion either partially or completely through the arm. The recess means in the specific embodiment comprises at least one through hole in the anti-vibration arm immediately adjacent the polarizing rib. In the specific embodiment, the anti-vibration arm is generally L-shaped, with one leg of the L-shaped arm projecting toward the panel for engagement therewith and with the through hole being formed in the other leg of the L-shaped arm adjacent the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
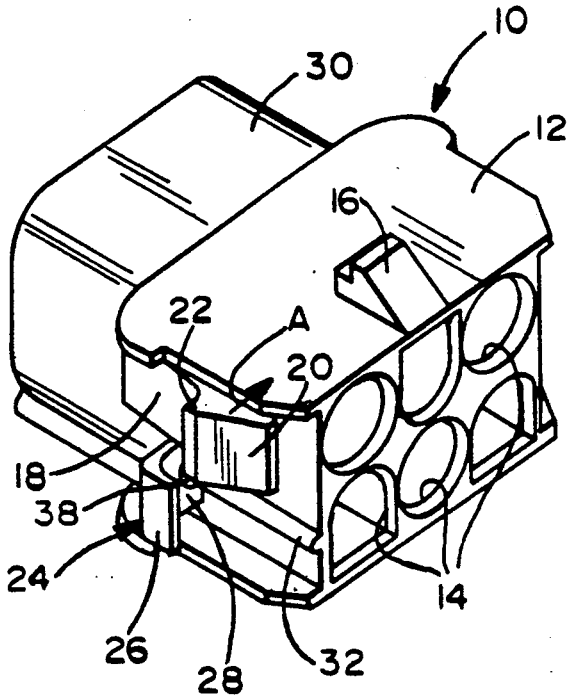
FIG. 1 is a perspective view of an electrical connector incorporating the concepts of the invention.

Referring to the drawings in greater detail, and first to FIG. 1, an electrical connector, generally designated 10, is shown to include a housing 12 having passages therethrough (not shown) for receiving and positioning appropriate terminals. The passages communicate with apertures 14 at the front end of the connector, the apertures being provided for receiving tubular portions of a complementary electrical connector (not shown) which has terminals for mating with the terminals of connector 10. A latch ramp 16 is formed integrally with the top of housing 12 for snapping engagement with a snap latch of the complementary connector. The entire connector housing 12 is integrally molded of dielectric material, such as plastic or the like.

Electrical connector 10 is designed as a panel-mounted connector for mounting in an aperture in a panel or the like. However, it should be understood that the anti-vibration means, including the stress relief means of the invention, can be used in a variety of applications where the connector is provided with an anti-vibration means, such as a cantilevered arm, a flange or the like.

With panel-mounted connector 10, a resilient latch finger 18 projects outwardly from opposite sides of the connector (only one latch finger 18 being visible in FIG. 1). The latch finger has a ramp surface 20 for positioning through the aperture in the panel to bias the finger inwardly in the direction of arrow "A" until a shoulder 22 snaps behind the side of the panel opposite the insertion direction of the connector.

Anti-vibration means in the form of a generally L-shaped anti-vibration arm, generally designated 24, projects outwardly from each opposite side of connector housing 12 spaced longitudinally from shoulder 22 of latch finger 18. The L-shaped arm includes one leg 26 projecting toward shoulder 22 and a panel sandwiched therebetween, and the other leg 28 of the L-shaped arm projects outwardly from a side wall 30 of housing 12 in a cantilevered fashion in contact with a polarizing rib 32.

Figure 2:
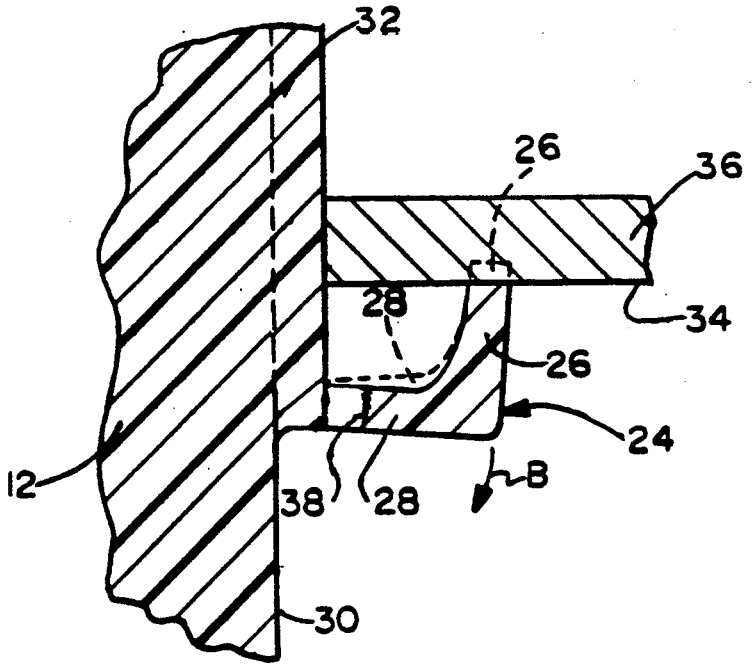
FIG. 2 is a fragmented sectional view, on an enlarged scale, through the anti-vibration arm area of the connector illustrated in FIG. 1, mounted to a panel and showing the anti-vibration arm yielding against the panel.

Referring to FIG. 2 in conjunction with FIG. 1, cantilevered anti-vibration arm 24 is shown with the distal end of leg 26 engaging a back side 34 of a panel 36. Latch finger 18 and its shoulder 22 are not visible in FIG. 2, because the figure is a section through anti-vibration arm 24, and the arm is offset relative to the latch finger as can be seen in FIG. 1. Nevertheless, when panel 36 is sandwiched between shoulder 22 and the distal end of leg 26 of the anti-vibration arm, the spacing therebetween is such that the arm yields in the direction of arrow "B" from its static position (shown by dotted lines) and its stressed position (shown in full lines). The stress without the stress receiving recess means 38 would be greatest at a point on leg 28 just above the polarizing rib.

The invention contemplates providing stress relief means in anti-vibration arm 24 to minimize stresses causes by yielding or flexing of the arm and to reduce or eliminate breakage of the arm. More particularly, recess means in the form of a through hole 38 is provided in leg 28 of the L-shaped arm. In other words, the hole is provided in the leg of the arm which is subject to flexing or bending relative to wall 30 of the connector housing.

In the preferred embodiment of the invention, through hole 38 is located immediately adjacent polarizing rib 32. The hole is in direct alignment with polarizing rib 32 and may be of substantially the same cross-sectional dimensions as that of the rib. This arrangement and dimensioning is easily fabricated during integral molding of the entire electrical connector housing by a core-thru at the location of the stress relief hole.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for mounting in an aperture in a panel, comprising:

a housing thickened on an outer surface of said housing by a polarizing means:

a yieldable anti-vibration arm formed integral with said polarizing means projecting from the housing for engaging said panel when the connector is mounted in the aperture to prevent vibration between the connector and the panel; and recess means in the anti-vibration arm having generally the same cross-sectional areas as that of the polarizing means and at a location to relieve stress in the arm caused by said polarizing means during yielding thereof.

2. The electrical connector of claim 1 wherein said polarizing means comprises an elongated rib.

3. The electrical connector of claim 1 wherein said recess means comprises at least one through hole in the anti-vibration arm.

4. The electrical connector of claim 1 wherein said housing includes wall means, said anti-vibration arm is generally L-shaped and cantilevered outwardly from the wall means, with one leg of the L-shaped arm projecting toward the panel and said recess means being formed in the other leg of the L-shaped arm.

5. The electrical connector of claim 1 wherein said housing includes a rigid wall from which the anti-vibration arm projects, and said recess means is located adjacent the polarizing means.

6. The electrical connector of claim 5 wherein said recess means comprises at least one through hole in the anti-vibration arm.

7. The electrical connector of claim 5 wherein said recess means comprises at least one hole partially through the anti-vibration arm.

8. The electrical connector of claim 7 wherein said hole partially through the anti-vibration arm takes a rectangular shape.

9. An electrical connector for mounting in an aperture in a panel, comprising:

a housing including a rigid wall and latch means defining abutment means for engaging a remote side of the panel and thickened on an outer surface of said housing by polarizing means;

a yieldable anti-vibration arm formed integral with said polarizing means projecting from the rigid wall of the housing, spaced from said abutment means for engaging a proximal side of the panel when the connector is mounted in the aperture of the panel to prevent vibration between the connector and the panel; and recess means in the anti-vibration arm having generally the same cross-sectional area as that of the polarizing means and located adjacent the polarizing means to relieve stress in the arm caused by said polarizing means during yielding thereof.

10. The electrical connector of claim 9 wherein said recess means comprises at least one through hole in the anti-vibration arm.

11. The electrical connector of claim 9 wherein said housing includes wall means, said anti-vibration arm is generally L-shaped and cantilevered outwardly from the wall means, with one leg of the L-shaped arm projecting toward the panel, and said recess means being formed in the other leg of the L-shaped arm.

12. The electrical connector of claim 9 wherein said recess means comprises at least one hole partially through the anti-vibration arm.

13. The electrical connector of claim 12 wherein said hole partially through the anti-vibration arm takes a rectangular shape.

14. The electrical connector of claim 13 wherein said means in the anti-vibration arm to relieve stress comprises at least one hole partially through the anti-vibration arm.

15. The electrical connector of claim 9 wherein said polarizing means comprises an elongated rib.

16. The electrical connector of claim 15 wherein said hole partially through the anti-vibration arm takes a rectangular shape.

17. An electrical connector, comprising:

a housing thickened on an outer surface thereof by polarizing means;

a yieldable anti-vibration arm formed integral with said polarizing means projecting from the housing for engaging an extraneous component when the connector is coupled in a mounting arrangement to prevent vibration between the connector and the component; and recess means in the anti-vibration arm having generally the same cross-sectional area as that of the polarizing means at a location to relieve stress in the arm caused by said polarizing means during yielding thereof.

18. The electrical connector of claim 17 wherein said recess means in the anti-vibration arm to relieve stress comprises at least one through hole in the anti-vibration arm.

19. The electrical connector of claim 17 wherein said housing includes wall means, said anti-vibration arm is generally L-shaped and cantilevered outwardly from the wall means with said means in the anti-vibration arm to relieve stress being located in a leg of the L-shaped arm projecting outwardly from the wall means.

20. The electrical connector of claim 17 wherein said housing includes a rigid wall from which the anti-vibration arm projects, and said means in the anti-vibration to relieve stress is located adjacent the polarizing means.

21. The electrical connector of claim 20 wherein said means in the anti-vibration arm to relieve stress comprises at least one through hole in the anti-vibration arm.

* * * * *